United States Patent [19]

Marlair et al.

[11] Patent Number: 4,736,711

[45] Date of Patent: Apr. 12, 1988

[54] FLUIDIZED-BED HEAT GENERATOR WITH IMPROVED MEANS FOR ASH REMOVAL AND HEAT RECOVERY

[75] Inventors: Guy Marlair, Douai; Alexandre Petrovic, Chatou, both of France

[73] Assignees: Charbonnages de France, Paris; Institut Francais du Petrole, Rueil Malmaison, both of France

[21] Appl. No.: 940,079

[22] Filed: Dec. 10, 1986

[30] Foreign Application Priority Data

Dec. 18, 1985 [FR] France ..... 85 18764

[51] Int. Cl.[4] ..... F23C 11/02

[52] U.S. Cl. ..... 122/4 D; 110/245; 110/263; 122/121; 122/182 S

[58] Field of Search ..... 110/245, 263, 233, 234, 110/235; 122/4 D, 13 R, 158, 31 A, 121, 126, 127, 128, 130, 131, 166 R, 182 R, 182 S, 46, 48, 114, 117, 118, 119; 431/7, 170; 165/104.16; 34/57 A; 432/58; 60/39.464

[56] References Cited

U.S. PATENT DOCUMENTS

| | | | |
|---|---|---|---|
| 1,684,201 | 9/1928 | Pollock | 122/182 S |
| 2,832,320 | 4/1958 | Thane et al. | 122/121 |
| 3,818,606 | 6/1974 | Marcellini | 34/57 A |
| 4,270,468 | 6/1981 | Robinson et al. | 110/245 |
| 4,273,073 | 6/1981 | Robinson | 122/4 D |
| 4,349,969 | 9/1982 | Stewart et al. | 122/4 D X |
| 4,408,566 | 10/1983 | Northcole et al. | 122/4 D |
| 4,455,969 | 6/1984 | Barker | 122/4 D |
| 4,565,184 | 1/1986 | Collins et al. | 122/46 X |
| 4,628,831 | 12/1986 | Delessard et al. | 110/245 |

FOREIGN PATENT DOCUMENTS

| | | | |
|---|---|---|---|
| 2582540 | 6/1985 | France . | |
| 1307220 | 2/1973 | United Kingdom . | |
| 1513795 | 6/1978 | United Kingdom | 122/4 D |
| 2073910 | 10/1981 | United Kingdom . | |
| 2109096 | 5/1983 | United Kingdom . | |

*Primary Examiner*—Steven E. Warner

*Attorney, Agent, or Firm*—Cushman, Darby & Cushman

[57] ABSTRACT

A fluidized bed heat generator with improved collector for ash removal and heat recovery comprises a central hearth having a fluidization grid at its lower end. The side wall of the hearth is enclosed by a hollow peripheral enclosure to define an intermediate volume therebetween which is connected both to the upper part of the hearth and to fume tubes. These fume tubes extend through the peripheral enclosure and open into a fume exit conduit such that fumes and entrained ash from the hearth can be directed via the intermediate volume and the fume tubes to the fume exit conduit. Water is arranged to circulate within the peripheral enclosure around the hearth and fume tubes.

11 Claims, 2 Drawing Sheets

FLUIDIZED-BED HEAT GENERATOR WITH IMPROVED MEANS FOR ASH REMOVAL AND HEAT RECOVERY

FIELD OF THE INVENTION

The invention relates to an intermediate-power, fluidized-bed heat generator comprising improved means for ash removal and for heat recovery, which may be used in particular for solid fuels in the form of particles (coals, granulated domestic wastes, and the like) or pastes (heavy oil fractions, residual muds, and the like).

A generator of this type, which operates using the fuidized-bed combustion technique has the advantage of employing a wide range of fuels. However, the implementation of a generator of this kind presents construction and industrialization problems related to the removal of ash and to the treatment of fumes.

Until the present time, these problems have been solved partially and in an imperfect manner; existing known generators are ill-suited to the combustion of ash-producing materials and make it necessary to install bulky and costly fume chambers.

For this reason, the known generators which are constructed as a single unit are of low power; more powerful generators generally employ a combination of one or more cells with water tubes (hearths), which are connected to a separate cell with fume tubes, whose overall bulk is large as a result. Furthermore, the prefabrication of such systems in a factory and their assembly are relatively time-consuming.

It is an aim of the invention to provide a generator of the type indicated above, by means of which the difficulties outlined above are substantially, if not completely, overcome, in a simple and effective manner.

SUMMARY OF THE INVENTION

In a heat generator employing a solid or pasty fuel, comprising a central hearth with a side wall and a fluidization grid for containing a fluidized bed, a hollow peripheral enclosure with means for the entry and exit of circulation water enclosing the central hearth, and a fume exit conduit connected to the central hearth, there is provided, according to the invention, that the peripheral enclosure defines with the central hearth at least one intermediate volume which is in communication with the central hearth in its upper part via openings for fumes and which is connected at its lower part to fume tubes via a first end of the latter; over a substantial part of their length, these fume tubes extend in the peripheral enclosure and they are connected via their second end to the fume exit conduit.

The intermediate volume formed in this manner is advantageously equipped, in its lower part, with a collector for gathering together and removing ash which is entrained with the fumes.

The intermediate volume constitutes a primary dust separator which forms an integral part of the generator upstream of the fume tubes and which protects these tubes against the danger of fouling and of premature erosion. This arrangement makes it possible to avoid the use of a fume chamber, which is frequently of mechanical and welded construction and which is strapped onto the heat generator.

The compactness of the generator according to the invention is improved thereby and its prefabrication is made easier.

Preferably, the fluidized-bed hearth has at least one side wall with water tubes, which is surrounded by the peripheral enclosure having a symmetrical arrangement which avoids the problems of differential expansion and of long-term behaviour of the generator.

For example, the vertical wall may consist of water tubes held together in a leakproof manner by membranes. This construction renders the generator easier to implement on an industrial scale and improves heat transfer.

In an embodiment, the fluidization grid forms part of the water-filled housing which is in communication with the peripheral enclosure. This design enables the temperature of the grid to be reduced, and this allows it to be manufactured in an inexpensive material. Furthermore, in this manner, all the walls bounding the fluidized bed, including the grid itself, take part in the heat exchange. This makes it possible to reduce the exchange surfaces to be immersed in the bed; consequently, the tubes which form these exchange surfaces may be arranged more freely, avoiding the regions where high erosion would be produced.

The fluidization grid used in the heat generator can be of a known type. For example, it may be a grid with openings which widen upwardly, such as described in FR-A-Nos. 2,171,945, 2,519,877, 85-08320 and 85-15580.

At least one of the walls of the hearth preferably has one or more openings equipped with a selective closing means. This opening enables the level of the fluidized bed to be regulated.

Alternatively, the ash collector contains a water circulation loop connected to the hollow peripheral enclosure. This loop makes an additional contribution to the removal of heat from the ash and further improves the output of the unit.

In an embodiment, the generator has a device for reinjecting the ash collected by a final dust separator (for example a multicyclone), connected to the circuit for the fumes leaving the boiler.

This device makes it possible to improve the removal of sulphur in situ, to reduce the unburnt material and to limit the ash removal points.

This device may be implemented, for example pneumatically, via a branch from the delivery of fluidization air or of secondary air, or mechanically via conveying by means of a screw conveyor.

Supplementary to this reinjection, it is possible to use the ash collected in the internal dust separator, wholly or partly, for example as a means for automatically supplying the bed with inert materials.

BRIEF DESCRIPTION OF THE DRAWINGS

Embodiments of the present invention will hereinafter be described, by way of example, with reference to the accompanying drawings, in which.

DESCRIPTION OF PREFERRED EMBODIMENTS

Figure 1:
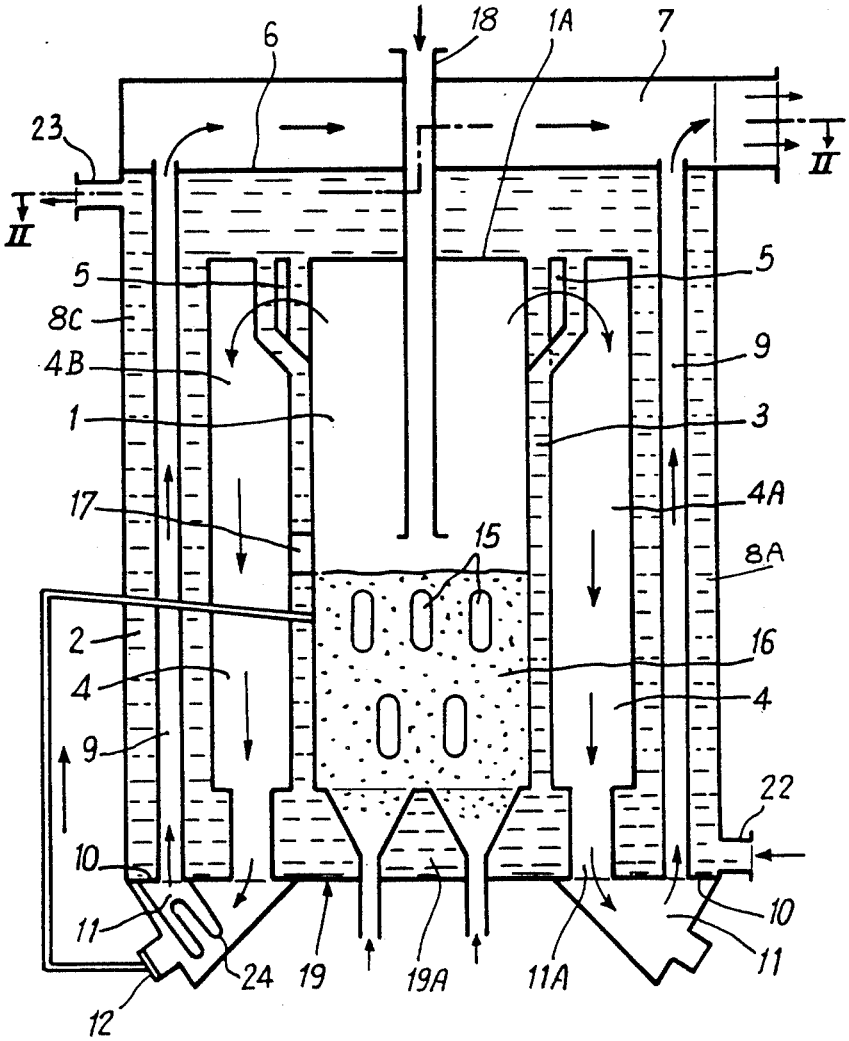
FIG. 1 is a vertical section, taken along line I—I of FIG. 2, of a heat generator of the invention.
Figure 2:
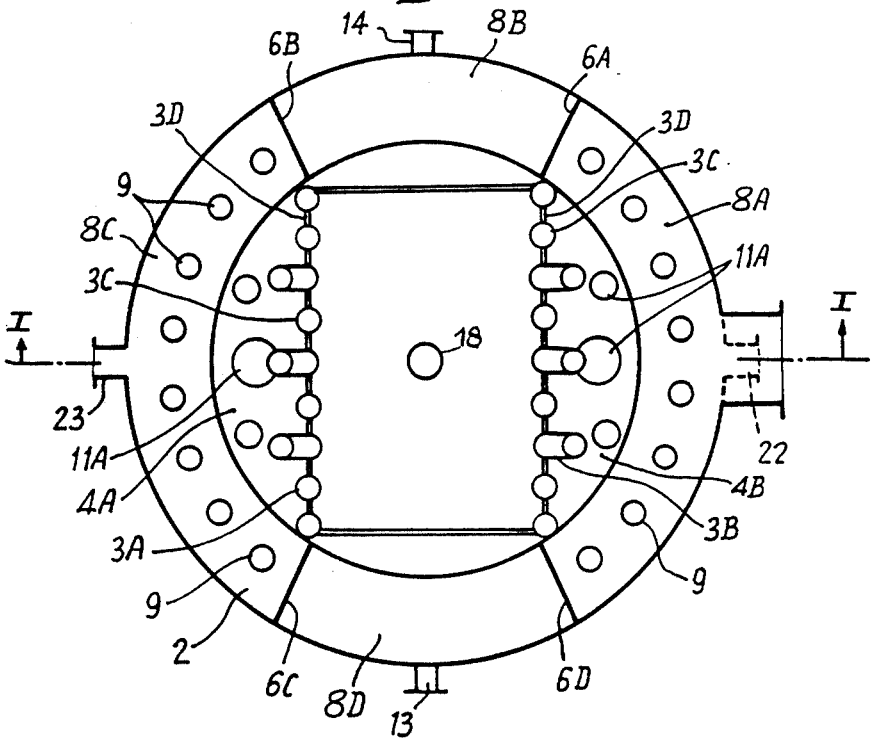
FIG. 2 is a horizontal section of the generator taken along line II—II of FIG. 1.

A heat generator of the invention is shown in FIGS. 1 and 2 and comprises a fuidized-bed hearth 1 of the type known per se which has a side wall 3. The hearth 1 is enclosed by a peripheral enclosure 2 which defines, together with the side wall 3, an intermediate volume 4. The hearth 1 could be cylindrical, as could the peripheral enclosure 2, and in this case the intermediate volume 4 would be annular. In the upper part of the hearth 1, openings 5 provide communication between it and the intermediate volume 4.

In the present embodiment, and as shown in FIG. 2, the hearth 1 has a rectangular overall configuration. The peripheral enclosure 2 is cylindrical and, together with the hearth 1, it bounds two separate and opposed intermediate volumes 4A, 4B, each of which is located on one of the larger sides of the rectangular hearth 1. The two larger sides 3A, 3B of the hearth 1 are formed of parallel water tubes 3C, which are spaced apart and connected together in a leakproof manner by intermediate membranes 3D, in a manner which is known per se. At the topmost part of the hearth 1, some of these tubes, preferably one out of every two, are offset towards the outside of the hearth 1 and the intermediate meabranes 3D are omitted from the offset outermost part of each tube 3C. This forms the upper openings 5, through which fumes originating from the hearth 1 can circulate.

In the example described, the hearth 1 is closed in its upper part, at a height above that of the openings 5, by an upper wall 1A which projects beyond the hearth 1 and which also closes the intermediate volumes 4A, 4B. Therefore, fumes can only enter the intermediate volumes by way of the upper openings 5. In addition, because of the existence of the upper wall 1A, the peripheral enclosure 2 covers the hearth 1 above the upper wall 1A. Thus, the peripheral enclosure extends around the side wall and the upper wall of the hearth 1 and encloses the hearth completely on all its sides. At its top, the peripheral enclosure 2 is closed by an upper wall 6. The wall 6 carries a fume exit conduit 7.

In the present example, the peripheral enclosure 2 is divided by radial internal partitions 6A, 6B, 6C, 6D, into four compartments formed as opposed pairs. Two opposed compartments 8A and 8C, which are largest in size in the circumferential direction, contain vertical tubes 9. These tubes 9 are spaced apart and extend between a lower wall 10 of the peripheral enclosure 2 and its upper wall 6. The tubes 9 pass through this upper wall 6 and open into the fume exit conduit 7. At its opposite lower end, each tube 9 passes through the lower wall 10 and opens into an ash collector 11. A respective ash collector 11 is provided beneath each of the two largest compartments 8A and 8C of the peripheral enclosure 2. Each collector 11 extends below the lower wall 10 and is in communication with a corresponding intermediate volume 4A, 4B, via a lower passage 11A. Combustion fumes, and ash entrained therein, which arrive from the upper passages 5 travel down through the intermediate volumes 4A, 4B, pass through the collectors 11 and rise in the tubes 9 to reach the fume exit conduit 7.

Each collector 11 is of sufficient depth for ash to collect therein without interrupting the fume circulation. Furthermore, as shown only on the left-hand side of FIG. 1, each collector 11 is equipped at 12 with pneumatic means known per se, for extracting ash and for reintroducing this ash into the fluidized bed, to ensure recycling.

The other two opposed compartments 8B and 8D are provided, respectively with a water supply 13 and a water outlet 14. In addition, both these compartments are connected, via the hearth 1, by way of water tubes 15 (which can only be seen in FIG. 1), which are submerged in the bed 16 of fuidized fuel material during operation. At the desired upper level capable of being reached by the bed 16, there is provided in the side wall 3 of the hearth 1 at least one overflow opening 17 which opens into the intermediate volume 4B. A channel 18 passes downwardly through the fume exit conduit 7, the upper wall 6 of the peripheral enclosure 2, and the upper wall 1A of the hearth 1, and extends within the hearth 1. The channel 18 terminates above the upper level of the fluidized bed 16. This channel 18 enables fuel to be supplied to the hearth 1. It should be noted that other methods of supplying fuel to the hearth 1 may be used. Preferably, the channel 18 is cooled by means of a forced water-circulation loop which is connected as a branch from the general supply exit circuit.

Figure 3:
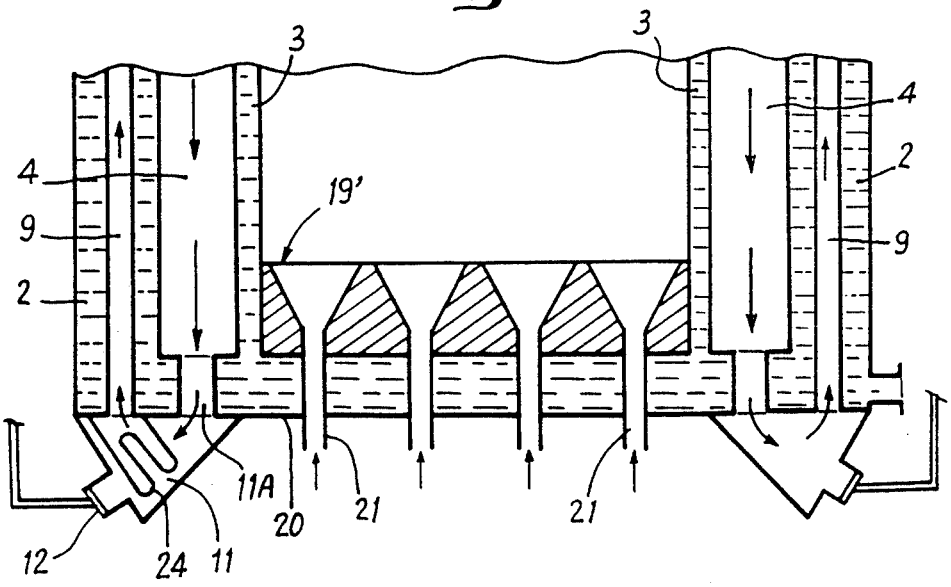
FIG. 3 is a partial vertical section of an alternative embodiment of a heat generator.

In FIG. 1, the grid 19 is shown as a hollow grid having an internal volume l9A, into which the water tubes of the side wall 3 open via their lower ends. These tubes 3C are therefore joined to the peripheral enclosure 2 in the region of the grid 19. In an alternative embodiment, as shown in FIG. 3, the fluidization grid 19′ is of traditional construction and rests on and is supported by a hollow housing 20. The internal volume of the housing 20 is in communication with the internal volume of the peripheral enclosure 2. Obviously, tubes 21, which supply fluidization gas to the usual orifices in the grid 19′, pass in a leakproof manner through this hollow housing 20. In another possible alternative, the grid is of traditional construction and is neither cooled nor supported by a cooled hollow housing.

In the two cases illustrated, where the grid 19 is hollow as shown in FIG. 1, and where the grid 19′ rests on a hollow housing 20 as shown in FIG. 3, a reduction in the mean temperature of the grid is obtained during operation, and this enables a less costly material to be used in the construction of the grid.

In all circumstances, even if no provision is made for using a hollow grid 19 or a grid 19′ supported by a hollow housing 20, a water inlet 22 is provided at a level below the peripheral enclosure 2, and a water outlet 23 is provided at a higher level. During operation, water circulates in the tubes which form the side wall 3 of the hearth 1, it also circulates along the upper wall 1A of the hearth, and it circulates along the outer wall which bounds the intermediate volume 4 and around the tubes 9, through which the fumes travel. Preferably, water is also circulated through the hollow grid 19 or through the hollow housing 20 supporting the grid 19′. In this manner, heat which is present in the fumes and the ash is recovered. Additionally, a water circulation inlet 24, which is connected to the internal volume of the peripheral enclosure 2, may be placed in the lower inner part of each ash collector 11, as can be seen in FIGS. 1 and 3.

Thus, virtually all the heat present in the ash may be recovered. At the same time, the ash is collected without the need for any bulky equipment and may then be readily disposed of, either in order to be finally discharged, or for recycling into the fluidized bed.

In some circumstances, it may become necessary to omit the tubes 15 which extend through the fluidized bed 16. In this case, the compartments 8B, 8D may also be omitted, the peripheral enclosure 2 then becoming a single enclosure which forms a ring surrounding the side wall of the hearth 1. The hearth may be cylindrical and the intermediate volume 4 may also form a ring surrounding the side wall of the hearth 1.

We claim:

1. A compact heat generator comprising:

a vertical central hearth having a side wall, a bottom end with a fluidization grid, an upper wall, a peripheral hollow enclosure having a lower wall and an upper wall and enclosing at least a part of the side wall of said hearth between the level of said grid and the level of said upper wall, said enclosure defining with the side wall of said hearth a fumes evacuating intermediate volume, the upper part of said side wall having openings for the fumes entering from said hearth into said intermediate volume, said peripheral hollow enclosure containing a plurality of vertical tubes spaced apart and extending between said lower wall and said upper wall of said enclosure, the lower end of said tubes being in communication by means of an ash collection with the lower end of said intermediate volume, said peripheral hollow enclosure having a water inlet and a water outlet for circulation of water therethrough, a fume exit conduit supported above said hearth and said vertical tubes extending outside said upper wall of said enclosure and being connected to said fume exit conduit.

2. A generator according to claim 1, wherein at least one communication passage is arranged to extend through the side wall of the hearth such that the interior of said hearth is selectively communicable with said intermediate volume substantially at the maxiumum level of the fluidized bed during operation.

3. A generator according to claim 1, wherein the side wall of the said hearth is formed of a plurality of water tubes which are close to each other and are connected in a leakproof manner by means of intermediate membranes, and wherein said intermediate volume is arranged to communicate with the said hearth by way of a diversion of a part of the length of some of the said water tubes releative to the other water tubes, the leakproof sealing between the said water tubes being locally removed by this diversion.

4. A generator according to claim 1, wherein the collector contains a water circulation circuit connected to the peripheral enclosure.

5. A generator according to claim 1, wherein the central hearth has a fluidization grid, a side wall and an upper wall, and wherein the peripheral enclosure surrounds the hearth around the side wall and the upper wall of the latter.

6. A generator according to claim 1, wherein the central hearth has a side wall formed of a plurality of water tubes which are close to each other, are connected in a leakproof manner by means of intermediate membranes and are in communication with the peripheral enclosure via their opposed ends.

7. A generator according to claims 5 or 6, wherein said water tubes are connected to the peripheral enclosure via their upper end which is away from the grid and which opens into the region of the said peripheral enclosure which covers the upper wall of the central hearth.

8. A generator according to claim 7, wherein some of the water tubes have a topmost part which is diverted outwards relative to the said hearth, the diversion removing the leakproof sealing between the said tubes with the diverted end part and the other water tubes to provide communication between the central hearth and the intermediate volume.

9. A generator according to claim 7 wherein the fume exit conduit is situated immediately above the region of the intermediate volume which covers the upper wall of the said hearth, and the fume tubes extend over their entire length in the peripheral enclosure and are connected via their opposed ends to the intermediate volume and to the fume exit conduit.

10. A generator according to claim 6, wherein the fluidization grid is hollow with an internal volume connected to the peripheral enclosure, and the water tubes extend from said grid and are in communication with the internal volume of the grid, the connection of the water tubes to the peripheral enclosure being provided by means of the internal volume of the said grid.

11. A generator according to claim 6, wherein the fluidization grid is supported by a hollow housing which communicates with the peripheral enclosure.

* * * * *